US009282786B2

(12) United States Patent
Farrell

(10) Patent No.: US 9,282,786 B2
(45) Date of Patent: Mar. 15, 2016

(54) FOOT EXERCISE DEVICE

(76) Inventor: Gerrard Farrell, Glasgow (GB)

( * ) Notice: Subject to any disclaimer, the term of this patent is extended or adjusted under 35 U.S.C. 154(b) by 700 days.

(21) Appl. No.: 13/122,175

(22) PCT Filed: Aug. 21, 2009

(86) PCT No.: PCT/GB2009/002049

§ 371 (c)(1),
(2), (4) Date: Apr. 29, 2011

(87) PCT Pub. No.: WO2010/040974

PCT Pub. Date: Apr. 15, 2010

(65) Prior Publication Data

US 2011/0224049 A1 Sep. 15, 2011

(30) Foreign Application Priority Data

Oct. 10, 2008 (GB) ..... 0818636.3
Nov. 6, 2008 (GB) ..... 0820331.7

(51) Int. Cl.

| | |
|---|---|
| ***A63B 23/10*** | (2006.01) |
| ***A43B 17/02*** | (2006.01) |
| ***A43B 7/14*** | (2006.01) |
| ***A43B 7/16*** | (2006.01) |
| ***A43C 11/22*** | (2006.01) |
| ***A43D 999/00*** | (2006.01) |

(52) U.S. Cl.

CPC . *A43B 17/02* (2013.01); *A43B 7/14* (2013.01); *A43B 7/144* (2013.01); *A43B 7/145* (2013.01); *A43B 7/16* (2013.01); *A43C 11/22* (2013.01); *A43D 999/00* (2013.01); *A63B 23/10* (2013.01)

(58) Field of Classification Search

USPC ..... 482/121–129

See application file for complete search history.

(56) References Cited

U.S. PATENT DOCUMENTS

| | | | |
|---|---|---|---|
| 478,166 | A | 7/1892 | Masden |
| 1,345,096 | A | 6/1920 | Mount |
| 1,509,793 | A | 9/1924 | Thompson |
| 1,587,749 | A | 6/1926 | Bierly |
| 1,671,096 | A | 5/1928 | Anderson |
| 1,911,390 | A | 5/1933 | Pullman |
| 1,978,244 | A | 10/1934 | Bach |
| 1,989,899 | A | 2/1935 | Vance |
| 2,022,883 | A | 12/1935 | Gee |

(Continued)

FOREIGN PATENT DOCUMENTS

| | | |
|---|---|---|
| DE | 202004003720 | 6/2004 |
| EP | 1752196 | 2/2007 |

(Continued)

OTHER PUBLICATIONS

International Search Report and Written Opinion, PCT/GB2009/002049, dated Dec. 8, 2009.

(Continued)

*Primary Examiner* — Stephen Crow

(74) *Attorney, Agent, or Firm* — Buchanan Nipper LLC

(57) ABSTRACT

A device (10) for exercising a foot (12) has a base (16) onto which the foot (12) to be exercised is located and an upper (18). A number of resilient members (20) are secured to the upper (18) and on moving the foot (12) between an extended position and a retracted position, the resilient members (20) provide a resistive force on the foot (12) which opposes the movement of the foot (12) between the extended and retracted positions.

18 Claims, 3 Drawing Sheets

(56) References Cited

U.S. PATENT DOCUMENTS

| | | | | | |
|---|---|---|---|---|---|
| 2,230,890 | A | | 2/1941 | Mcclenathen | |
| 2,250,493 | A | | 7/1941 | Milne | |
| 2,374,730 | A | | 5/1945 | De Catlin | |
| 3,088,458 | A | | 5/1963 | Stewart | |
| 3,295,847 | A | | 1/1967 | Matt, Sr. | |
| 3,297,320 | A | | 1/1967 | Di Benedetto | |
| 3,472,508 | A | | 10/1969 | Baker et al. | |
| 3,625,203 | A | | 12/1971 | Wadelton | |
| 3,636,946 | A | | 1/1972 | Hardy | |
| 3,741,540 | A | | 6/1973 | Shimizu | |
| 3,769,722 | A | * | 11/1973 | Rhee | 36/2 R |
| 3,812,603 | A | * | 5/1974 | Goodman | 36/136 |
| 3,863,916 | A | | 2/1975 | Cline | |
| 3,917,261 | A | | 11/1975 | Small et al. | |
| 4,061,138 | A | * | 12/1977 | Bernstein | 602/11 |
| D251,313 | S | | 3/1979 | Jinotti | |
| 4,159,111 | A | | 6/1979 | Lowth | |
| 4,177,583 | A | * | 12/1979 | Chapman | 36/77 R |
| 4,279,415 | A | | 7/1981 | Katz | |
| 4,371,160 | A | | 2/1983 | Shooltz | |
| 4,461,472 | A | | 7/1984 | Martinez | |
| 4,501,421 | A | | 2/1985 | Kane et al. | |
| D281,343 | S | | 11/1985 | Krive | |
| 4,577,861 | A | | 3/1986 | Bangerter et al. | |
| 4,623,141 | A | | 11/1986 | Salvino | |
| 4,689,898 | A | | 9/1987 | Fahey | |
| 4,733,859 | A | | 3/1988 | Kock et al. | |
| 4,739,986 | A | | 4/1988 | Kucharik et al. | |
| 4,870,761 | A | | 10/1989 | Tracy | |
| 5,005,560 | A | | 4/1991 | Quam et al. | |
| 5,035,421 | A | | 7/1991 | Scheller | |
| 5,039,093 | A | | 8/1991 | Collier | |
| 5,087,036 | A | | 2/1992 | Cooper | |
| D325,968 | S | | 5/1992 | Nofsinger | |
| 5,127,892 | A | | 7/1992 | Sawdon | |
| 5,142,797 | A | | 9/1992 | Cole, III | |
| 5,176,598 | A | | 1/1993 | Gardner | |
| 5,256,118 | A | | 10/1993 | Chen | |
| 5,267,923 | A | | 12/1993 | Piaget et al. | |
| 5,267,924 | A | | 12/1993 | Miller et al. | |
| 5,304,106 | A | | 4/1994 | Gresko | |
| 5,368,535 | A | | 11/1994 | Twardokens | |
| 5,368,536 | A | | 11/1994 | Stodgell | |
| 5,396,718 | A | * | 3/1995 | Schuler et al. | 36/38 |
| 5,413,543 | A | | 5/1995 | Drago | |
| 5,433,684 | A | | 7/1995 | Carrillo | |
| 5,536,226 | A | | 7/1996 | Gordon | |
| 5,545,113 | A | * | 8/1996 | Bobich | 482/125 |
| 5,643,148 | A | | 7/1997 | Naville | |
| 5,645,516 | A | | 7/1997 | Foster | |
| D383,813 | S | | 9/1997 | Zoller | |
| 5,702,354 | A | | 12/1997 | DeSpain et al. | |
| 5,732,481 | A | | 3/1998 | Farhad | |
| 5,737,811 | A | | 4/1998 | Rashid | |
| D397,746 | S | | 9/1998 | Drach et al. | |
| 5,802,743 | A | | 9/1998 | Chien | |
| 5,851,166 | A | | 12/1998 | Bernardson | |
| 5,891,002 | A | | 4/1999 | Maki | |
| 5,897,464 | A | | 4/1999 | Mcleod | |
| 5,924,219 | A | * | 7/1999 | Healy et al. | 36/114 |
| 5,940,994 | A | | 8/1999 | Allen | |
| 5,984,841 | A | | 11/1999 | John | |
| 6,042,520 | A | | 3/2000 | Cantero | |
| 6,063,010 | A | | 5/2000 | Howd et al. | |
| 6,063,013 | A | | 5/2000 | Vathappallil | |
| 6,105,283 | A | | 8/2000 | Park | |
| 6,419,611 | B1 | | 7/2002 | Levine et al. | |
| 6,572,514 | B1 | | 6/2003 | Calafato | |
| 6,802,139 | B2 | * | 10/2004 | Pitts et al. | 36/51 |
| 6,821,235 | B1 | | 11/2004 | Johnson et al. | |
| 6,942,604 | B2 | | 9/2005 | Teff | |
| 7,300,026 | B2 | | 11/2007 | Pap | |
| 7,364,534 | B2 | | 4/2008 | Zoller et al. | |
| 7,549,201 | B2 | * | 6/2009 | Kraft et al. | 24/713 |
| D596,246 | S | | 7/2009 | Nofsinger | |
| 7,614,978 | B2 | | 11/2009 | Piaget et al. | |
| D622,789 | S | | 8/2010 | Gillis | |
| 7,771,327 | B1 | | 8/2010 | Reams | |
| 7,794,368 | B2 | | 9/2010 | Rutherford | |
| 2002/0165069 | A1 | | 11/2002 | Ravikumar et al. | |
| 2004/0009850 | A1 | | 1/2004 | Teff | |
| 2004/0194348 | A1 | | 10/2004 | Campbell et al. | |
| 2006/0168785 | A1 | | 8/2006 | Kraft et al. | |
| 2006/0265910 | A1 | * | 11/2006 | Lampley | 36/132 |
| 2007/0130800 | A1 | * | 6/2007 | Twomey | 36/50.1 |
| 2007/0294922 | A1 | * | 12/2007 | Ma et al. | 36/142 |
| 2008/0113854 | A1 | | 5/2008 | Ferri | |
| 2011/0124473 | A1 | | 5/2011 | Kole et al. | |

FOREIGN PATENT DOCUMENTS

| | | | |
|---|---|---|---|
| GB | 5187 | | 0/1909 |
| JP | 2000296003 | A | 10/2000 |
| JP | 2006-230802 | A | 9/2006 |
| JP | 2007-082611 | A | 4/2007 |
| WO | 9702765 | | 1/1997 |
| WO | 2008107687 | | 9/2008 |

OTHER PUBLICATIONS

United Kingdom Search Report, GB0820331.7, dated Mar. 17, 2009.
European Examination Report, European Regional Phase Entry of PCT/GB2009/002049, dated Nov. 26, 2013.
Japanese Examination Report, Japanese National Phase Entry of PCT/GB2009/002049, with English translation thereof, dated Nov. 19, 2013.
Annual Report, Scottish Health Innovations Ltd, 2007.
EPO Search Report dated Jun. 5, 2015.

* cited by examiner

FOOT EXERCISE DEVICE

FIELD OF THE INVENTION

This invention relates to exercising the foot and, in particular, but not exclusively, to a device for use in strengthening the muscles of the foot associated with the plantar fascia of the foot.

BACKGROUND OF THE INVENTION

Many people suffer from foot pain and, as might be expected, those who spend long periods of time bearing weight on their feet or those who repeatedly exert large loads on their feet such as sportspeople are particularly affected. While in many cases foot pain is temporary or inconvenient, in more serious cases the pain can be debilitating.

Foot pain may be caused, for example, by a condition known as plantar fasciitis which can result from overstretching of the plantar fascia or repeated overloading.

Treatment or relief from foot pain can be achieved in a number of ways. For example, drugs may be used to relieve the symptoms of the pain and to provide time to recover. However, recovery may require long periods of inactivity. Physiotherapy may also be used to assist in rehabilitation or to strengthen the foot. For example, specific exercises can be adopted in an attempt to strengthen the muscles associated with the plantar fascia and so help protect it from further damage.

SUMMARY OF THE INVENTION

According to a first aspect of the present invention there is provided a foot exercise device for strengthening the foot and associated structures, the device comprising:

a substantially inflexible base for receiving a foot to be strengthened thereon; and a resilient member adapted to exert a resistive force on the foot as the foot is moved between an extended position where the toes of the foot are directed towards a front portion of the base and a retracted position where the toes are pulled towards the heel of the foot.

Embodiments of the present invention permit the foot, and in particular the muscles associated with the plantar fascia of the foot, to be strengthened as the resilient member provides a resistive force on the foot as it is moved from an extended position, such as a dorsiflexed position, to a retracted position, such as a plantarflexed position. The resistive force may act to oppose arching of the foot so that the region of the foot to be strengthened is specifically worked while overcoming the resistive force. Accordingly, the device is arranged to target a particular area of the foot, such as the muscles associated with the plantar fascia, which is to be strengthened. Repeated exercise over time assists in progressive strengthening which can assist with preventing flattening of the arch and injury to the plantar fascia.

Furthermore, the provision of a substantially inflexible base permits the foot to work against the base without causing the base to flex, thereby ensuring that the resistive force is directed towards the region of the foot to be strengthened rather than to flexing the base.

The base may comprise an inclined front portion and, in particular embodiments, the base may comprise an upwardly directed front portion against which the foot can work. For example, the provision of an inclined front portion may assist in artificially lifting the front portion of the foot and may provide a surface against which the toes of the foot can work to further assist in directing the exercise towards the region of the foot to be strengthened. Repeatedly exercising the foot by working the foot against the inclined front portion assists in progressive strengthening of the foot for example acting to strengthen the muscles associated with the plantar fascia. It has been found that where a user may otherwise be unable to lift the arch of their foot independently, the provision of an inclined front portion facilitates an initial lifting of the arch to assist those users in performing the movement between the extended and retracted positions.

The resilient member may be of any suitable form. For example, the resilient member may comprise an elastic band, cord or the like. Alternatively, or in addition, the resilient member may comprise a spring. The resilient member may be adapted to stretch and contract in response to movement of the foot between the extended and retracted positions, whereby repeated movement facilitates progressive strengthening of the foot, for example the muscles associated with the plantar fascia.

In particular embodiments, a plurality of resilient members may be provided and each resilient member may be of the same or different resistance as required to provide a selected resistive force on the foot.

The, or each, resilient member may be adapted to be removed and/or interchanged to permit the selected resistive force to be modified to strengthen the foot as required.

The base may be of any suitable shape. For example, the base may be shaped to assist in preventing the toes of the foot from becoming squeezed together and may also facilitate use of the device on either foot as required. In particular embodiments, the base may comprise a substantially square front portion.

The base may be constructed from any suitable material. In particular embodiments, the base may be constructed from a rigid polymeric material, though any other suitable material, for example, wood or ceramic may be used where appropriate.

An outer surface of the base may be configured to oppose movement of the base during exercise of the foot. For example, the outer surface may comprise a non-slip surface or may comprise or provide mounting for a high friction material. Alternatively, the outer surface of the base may comprise ridges, grooves or other surface texture to resist movement of the base. Beneficially, opposing slippage or movement of the device may assist in facilitating efficient movement of the foot on the base, however, it will be recognised that the device may be free to move with the user at rest.

An inner surface of the base may define, or provide mounting for, a low friction surface for facilitating movement of the foot on the base between the extended and retracted positions.

The device may further comprise a first insert adapted for location on the base and the insert may comprise a substantially planar element, for example. For example, the insert may comprise a low friction material for facilitating movement of the foot between the extended and retracted positions and in particular embodiments the first insert may comprise a polythene material or the like.

The device may further comprise at least one wedge insert adapted for location on the base. The wedge insert may be adapted for location on the front portion of the base and may, for example, be adapted for location between the base and the first insert. In particular embodiments, the device may comprise a plurality of different wedge inserts to permit the angle of incline to be selected depending on the degree of exercise required and/or the anatomy of the user.

The device may comprise an upper coupled to the base and the base and the upper may together define a shoe into which the foot may be inserted. The upper may be constructed from any suitable material. For example, the upper may be constructed from a substantially inflexible material and, in particular embodiments, the upper may be constructed from a rigid canvas material or the like. The provision of a relatively inflexible upper may obviate or limit the degree to which the upper will stretch, thereby increasing the efficiency of the strengthening exercise.

The, or each, resilient member may be coupled to at least one of the upper and the base. For example, the, or each, resilient member may be secured by anchors and the anchors may comprise cleats, eyelets or other suitable anchor. In alternative embodiments, the ends of the, or each, resilient member may be tied to at least one of the upper and the base.

The device may comprise a sock, bag or the like for receiving the foot therein. The sock may be constructed from any suitable material. In particular embodiments, the sock may be constructed from a low friction material such as polythene or the like. The provision of a low friction sock facilitates easy movement of the foot relative to the base to assist in exercising the foot.

The device may comprise a tongue and, in particular embodiments, the tongue may be pivotably secured to the front portion of the base. The provision of a tongue pivotably coupled to the front portion may beneficially facilitate access to the base. The tongue may be adapted for location between the resilient member and the foot and the tongue may assist in providing padding to protect the foot. The tongue may also assist in forming an enclosure around the foot and may assist in location of the foot on the base.

At least one of the first insert and wedge insert, or inserts, may be composed of a material which compresses under a load induced by movement of the foot between the retracted, or plantarflexed, position and the extended, or dorsiflexed, position and returns to its former shape when the load is reduced or removed. The inserts may, for example, comprise a memory foam material, such as a visco-elastic polyurethane foam, though any suitable material may be used.

The device may further comprise a resilient element, such as a gel pad or other suitable element, which is adapted for location in a midfoot region of the device. In use, the first insert, wedge insert and/or the resilient element may be compressed and then expanded as the foot is moved between the retracted and the extended positions, this assisting in increasing the flexibility of the foot and, in particular embodiments, to increase the venous return from the lower leg.

According to a second aspect of the present invention, there is provided a method for strengthening the muscles alongside the plantar fascia of a foot, the method comprising:

providing a substantially inflexible base and locating a foot to be strengthened on the base; and exerting a resistive force on the foot when the foot is moved from an extended position where the toes of the foot are directed towards a front portion of the base to a retracted position where the toes are pulled towards the heel of the foot.

The method may comprise repeatedly moving the foot between the extended and retracted positions. In use, repeated movement of the foot between the extended position and the retracted position may facilitate strengthening of the arch of the foot and assist in the prevention and/or treatment of plantar fasciitis.

The method may further comprise selecting the resistive force to oppose arching of the foot. Thus, the resistive force may be selected so that the region of the foot to be strengthened is specifically worked when overcoming the resistive force.

The method may further comprise inclining the toes relative to the base, whereby in use the foot works against the incline when moving from the extended position to the retracted position.

It should be understood that the features defined above in accordance with any aspect of the present invention may be utilised, either alone or in combination with any other defined feature, in any other aspect of the invention.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
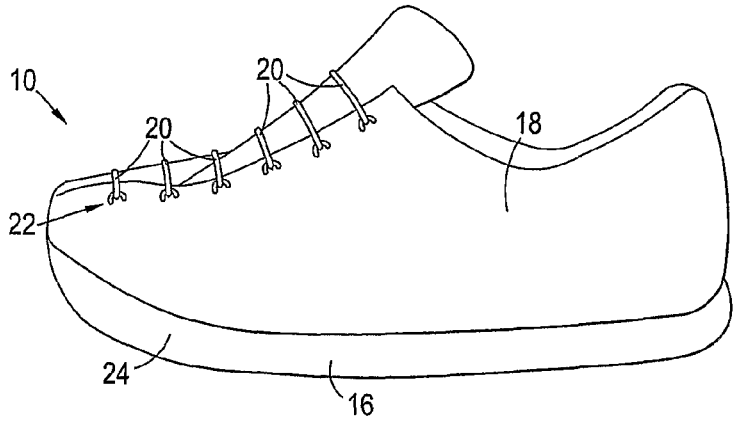
FIG. 1 is a diagrammatic side view of a foot exercise device in accordance with an embodiment of the present invention.
Figure 2:
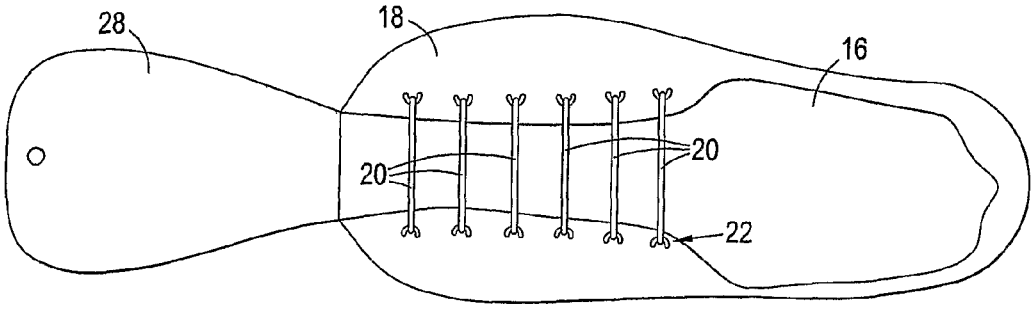
FIG. 2 is a diagrammatic top view of the foot exercise device of FIG. 1.

Referring initially to FIGS. 1 and 2 of the drawings, there is shown a foot exercise device 10 according to an embodiment of the present invention. In use, the device 10 is used to facilitate strengthening exercises to be carried out on a foot (reference 12 in FIGS. 3*a* and 3*b*), and in particular the plantar fascia 14, to overcome or prevent flattening. Repeated exercise of the foot 12 over time facilitates progressive strengthening, for example acting to shorten the plantar fascia 14 without over-stretching the foot 12 and connected elements which may otherwise result in complications.

The device 10 has a base 16 onto which the foot 12 to be exercised is placed and a rigid canvas upper 18 which surrounds the foot 12 when located on the base 16. A number of resilient members in the form of elastic bands 20 are secured to the upper 18, and as shown most clearly in FIG. 2, each of the bands 20 is secured around cleats 22 formed in the upper 18.

The base 16 is manufactured from a substantially rigid and inflexible material and has an upwardly inclined front portion 24. Thus, when the foot 12 is located on the base 16, the user's toes 26 (FIGS. 3*a* and 3*b*) are provided on the upwardly inclined front portion 24 so that the toes 26 are flexed upwards when at rest. The inclined portion 24 assists in providing a surface against which the foot 12 can be worked when moving from an extended position (as shown in FIG. 3*a*) to a retracted position (as shown in FIG. 3*b*) and for those users who otherwise are unable to provide any arching of their foot 12, the inclined portion 24 provides an initial artificial lifting of the toes.

As shown most clearly in FIG. 2, the front portion 24 of the device 10 is broad and substantially square, this assisting in preventing the users toes 26 from being squeezed or crushed together in use and permits use of the device 10 on either a left or a right foot 12.

In the embodiment shown in the Figures, a tongue 28 is provided, the tongue 28 being stitched to the front of the device 10 so that the tongue 28 is pivotable relative to the base 16. In the position shown in FIG. 1, the tongue 28 is positioned between the bands 20 and the upper surface of the foot 12 and provides padding between the foot 12 and the bands 20.

Figure 3A:
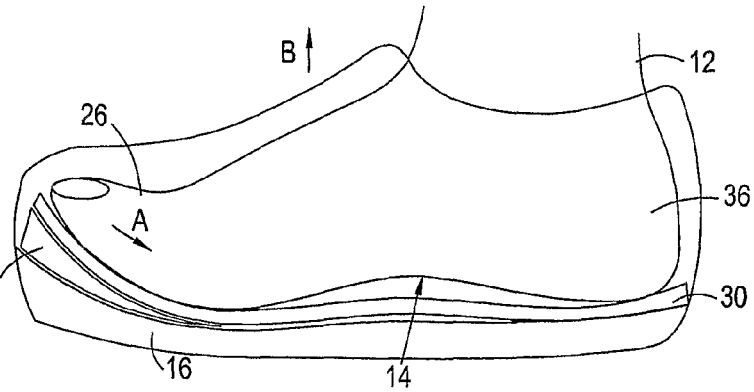
FIG. 3*a* is a diagrammatic ghosted side view of the foot exercise device of FIGS. 1 and 2 shown with a foot in an extended position.
Figure 3B:
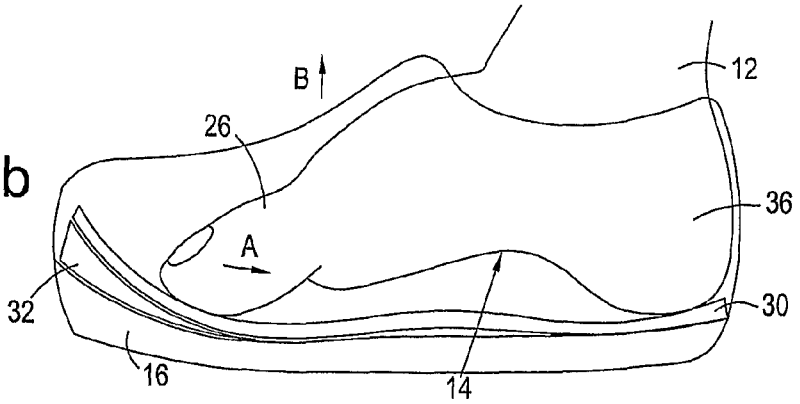
FIG. 3*b* is a diagrammatic ghosted side view of the foot exercise device of FIGS. 1 and 2 shown with the foot in a retracted position.
Figure 4:
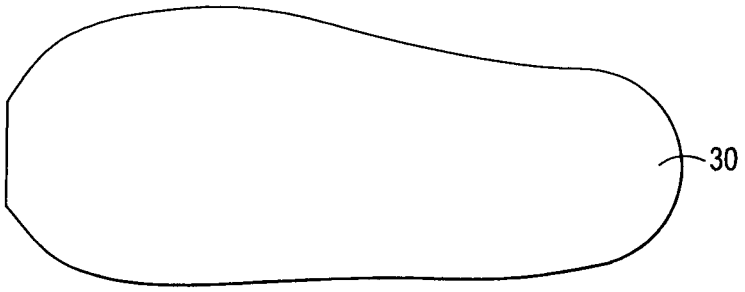
FIG. 4 is a top view of a first insert of the foot exercise device of FIGS. 1 to 3.
Figure 5A:
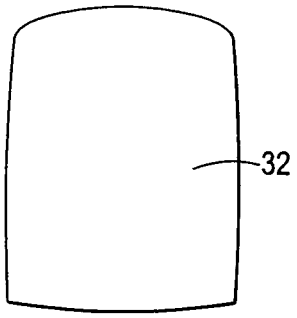
FIG. 5*a* is a top view of a wedge insert of the foot exercise device of FIGS. 1 to 4.
Figure 5B:
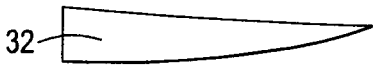
FIG. 5*b* is a side view of the wedge insert of the foot exercise device of FIG. 5*a;*

In reference now to FIGS. 3*a* and 3*b* which show ghosted side views of the device 10 and to FIGS. 4, 5*a* and 5*b*, a number of inserts are provided which permit the device 10 to be customised and adapted in use.

FIG. 4 shows a top view of an insole 30 which forms a first insert of the device 10. As shown in FIGS. 3*a* and 3*b*, the insole 30 is provided between the base 16 and the foot 12. The insole 30 is constructed from a flexible, hard wearing and low friction material such as polythene and assists in facilitating free movement of the foot 12 relative to the base 16.

FIGS. 5*a* and 5*b* show top and side views, respectively, of a wedge 32 which provides a second insert of the device 10. As shown in FIGS. 3*a* and 3*b*, the wedge 32 is provided on the base 12 and under the insole 30, thereby increasing the angle of incline of the front portion 24. It will be understood that the angle of incline of the wedge 32 can be selected depending on the requirements of the user and the degree of strengthening that is required. For example, in the case of people with flat feet who cannot easily arch their foot 12, the wedge 32 provides a greater slope to work against.

Figure 6:
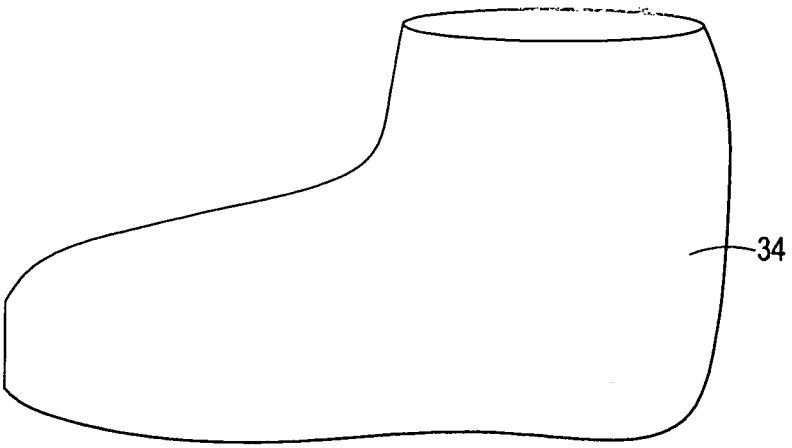
FIG. 6 is a side view of the sock of the foot exercise device of FIGS. 1 to 5*b;*

Referring to FIG. 6, for ease of operation, a polythene sock 34 can be worn over the foot 12 to be strengthened, the sock 34 providing a reduced friction surface between the foot 12 and the device 10 to facilitate movement between the foot 12 and the device 10.

In use, the foot 12 is initially positioned within the device 10 in a first, extended foot position (shown in FIG. 3*a*) whereby the toes 26 are directed towards and rest on the inclined front portion 24. The user then adopts a second, retracted foot position (shown in FIG. 3*b*) by pulling their toes 26 towards their heel 36 (that is, in the direction shown by arrow A in FIG. 3*a*). This causes the top of the foot 12 to arch upwards (in the direction shown by arrow B in FIG. 3*a*) against the resistance force provided by the bands 20. As the bands 20 are elasticated, these stretch when the foot 12 is moved from the extended position to the retracted position and shorten when the foot 12 is moved from the retracted position to the extended position. Accordingly, the device 10 is arranged to provide control over the degree of movement permitted by the foot 12 and assists in ensuring that the movement carried out exercises the plantar fascia region 14 of the foot 12. Due to the use of the device 10 over long periods, the muscles of the foot 12 become stronger and protect the plantar fascia.

It should be understood that the embodiment described herein is merely exemplary and that various modifications may be made thereto without departing from the scope of the invention.

For example, the materials used in the upper, the insole, the wedge and, where appropriate, the inner surface of the base should be selected to reduce friction.

In addition, while one wedge is shown, it will be recognised that a number of wedges may be provided as required. Thus, in place of a plurality of different wedges with different inclines, a plurality of similar wedges may be provided which together provide the required incline.

In the embodiment shown, the wedge is provided between the insole and the base, however, it will be understood that the wedge could be provided at any suitable location, for example above the insole or, where an insole is not provided, between the foot and the base.

Figure 7A:
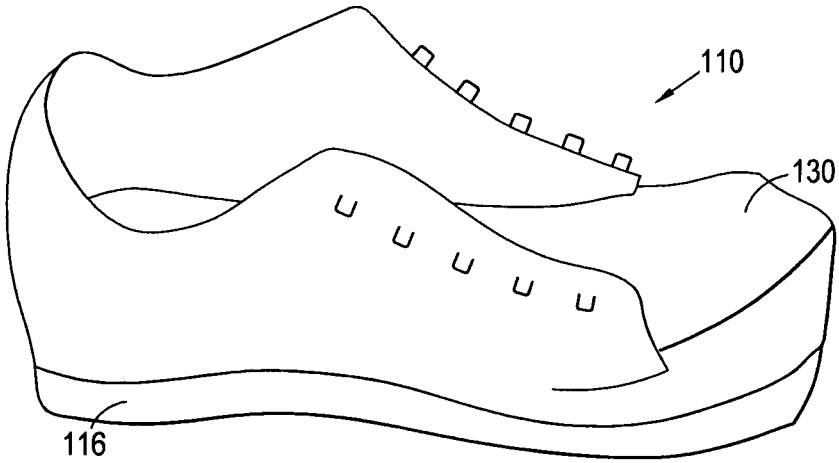
FIG. 7*a* is a side view of a foot exercise device according to an alternative embodiment of the present invention.
Figure 7B:
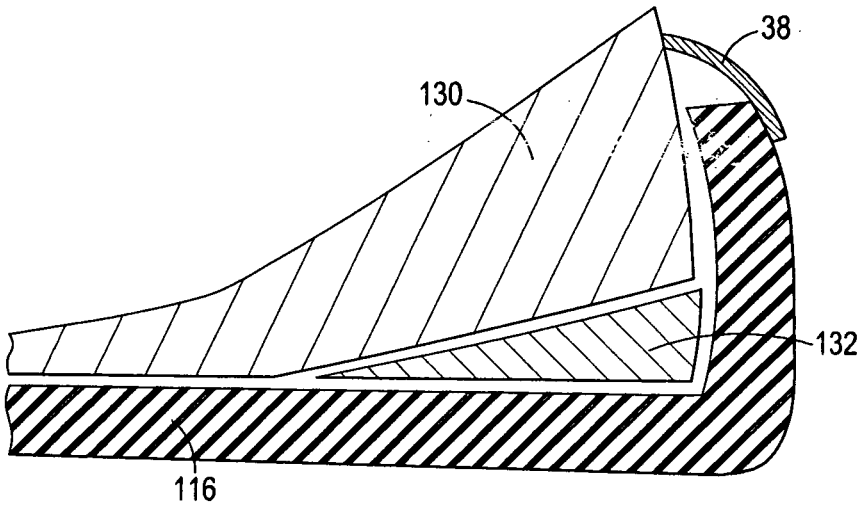
FIG. 7*b* is a sectional view of a front portion of the device of FIG. 7*a.*

A device according to an alternative embodiment of the invention is shown in FIGS. 7*a* and 7*b* in which like components are indicated by like numerals incremented by 100. Referring initially to FIG. 7*b*, the device 110 has a substantially inflexible base 116 and an insert or insole 130. A front portion of the insole 130 is coupled to a front portion of the base 116 by a securing device 38, such as an elastic band or cord, and the securing device 38 secures the insole 130 to the base 116 while permitting the insole 130 to be moved into and out from the device 110. In the embodiment shown, the insole 130 is releasably secured to the base so that the insole can be removed for replacement or repair.

A wedge insert 132 is provided for location on the front, or anterior, portion of the base 116 and the wedge 132 is located between the base 116 and the insole 130. Although one wedge 132 is shown in FIG. 7*b*, it will be understood that a number of different wedges 132 may be provided individually or in combination to provide for variability of the incline.

In use, the insole 130 allows for greater ease of adjustment of the incline of the foot since the insole 130 can be easily moved away to permit access to the base 116 to facilitate adjustment, removal or replacement of the wedge inserts 132 and then moved into position above the inserts 132 during use of the device.

In the embodiment shown, a front, or anterior, portion of the base 116 forms a non-flexible containing member which, in addition to or as an alternative to the tongue, provides an enclosure around front portion of the foot.

In alternative embodiments, the base against which the foot works is adjustable between uses. For example, a front, or anterior, portion of the base may be formed as a separate component coupled to the remainder of the base via a coupling, such as a hinge or plurality of hinges, which allow the front section to be adjusted and then fixed in position.

In use, a device according to particular embodiments of the present invention, as well as being used for strengthening the structures of the foot, and in particular the plantar fascia and associated muscles, may also be used to increase the flexibility of the foot and/or to increase the venous return from the lower leg. The effect of increasing the venous return through exercise of the foot is generally known as the venous pump or plantar pump and this may be achieved with embodiments of the present invention, for example, by providing a wedge insert composed of a material which compresses under load and returns to its former shape when the load induced by movement of the foot between the retracted and extended positions is reduced or removed. Additionally, or alternatively, a resilient element, such as a gel pad or the like, may be placed under the midfoot area of the insole to assist in activating the plantar venous pump when the foot is moved between the retracted and extended positions during use of the device.

The invention claimed is:

1. A foot exercise device for exercising the muscles of a foot, the device comprising:

a base for receiving a foot to be exercised thereon, the base being substantially inflexible in that it permits the foot to work against the base without causing the base to flex; and a resilient member adapted to exert a resistive force on an upper portion of the foot as the foot is moved from an extended position where the toes of the foot are directed towards a front portion of the base to a retracted position where the toes are pulled towards the heel of the foot, wherein the base for receiving the foot thereon comprises an upwardly directed front portion which supports the toes in a dorsiflexed position and against which the foot can work.

2. A device according to claim 1, wherein the resistive force is adapted to resist arching of the foot.

3. A device according to claim 1, wherein the resilient member comprises at least one of: an elastic band, and a spring.

4. A device according to claim 1, wherein a plurality of resilient members are provided, the or each resilient member adapted to be interchanged to permit the resistive force to be modified.

5. A device according to claim 1, wherein an outer surface of the base is configured to oppose movement of the base during exercise of the foot.

6. A device according to claim 1, wherein an inner surface of the base defines or provides mounting for a low friction surface.

7. A device according to claim 1, further comprising a first insert adapted for location on the base.

8. A device according to claim 7, wherein at least one of:

the first insert comprises a substantially planar element;

the first insert comprises a low friction material; and the first insert is composed of a material which compresses under a load induced by movement of the foot between the retracted and extended positions and which returns to its former shape when the load is reduced or removed.

9. A device according to claim 1, further comprising at least one wedge insert adapted for location on the base.

10. A device according to claim 9, wherein at least one of:

the wedge insert is adapted for location on the front portion of the base;

the device comprises a plurality of different wedge inserts; and the wedge insert is composed of a material which compresses under a load induced by movement of the foot between the retracted and extended positions and which returns to its former shape when the load is reduced or removed.

11. A device according to claim 1, further comprising an upper coupled to the base.

12. A device according to claim 11, wherein at least one of:

the base and the upper together define a shoe for receiving the foot; and the upper is constructed from a substantially inflexible material or from a rigid canvas material.

13. A device according to claim 11, wherein at least one of:

at least one resilient member is coupled to the upper; and at least one resilient member is secured to the upper by at least one of anchors and cleats.

14. A device according to claim 1, wherein at least one of:

at least one resilient member is coupled to the base; and at least one resilient member is secured to the base by at least one of anchors and cleats.

15. A device according to claim 1, further comprising a sock for receiving the foot therein, wherein the sock is constructed from at least one of a low friction material and polythene.

16. A device according to claim 1, further comprising a tongue pivotably secured to the front portion of the base.

17. A method for exercising the muscles of a foot, the method comprising:

providing a base and locating a foot to be exercised on the base, the base being substantially inflexible in that it permits the foot to work against the base without causing the base to flex; and providing a resilient member adapted to exert resistive force on an upper portion of the foot when the foot is moved from an extended position where the toes of the foot are directed towards a front portion of the base to a retracted portion where the toes are pulled towards the heel of the foot; and said method further comprising at least one of:

supporting the toes in a dorsiflexed position;

supporting the toes in a dorsiflexed position and exercising the foot by moving the toes of the foot from a dorsiflexed position to a plantarflexed position;

inclining the toes relative to the base; and inclining the toes relative to the base and working the foot against the incline when moving between the extended and retracted positions.

18. The method of claim 17, further comprising at least one of:

repeatedly moving the foot between the extended and retracted positions; and selecting the resistive force to oppose arching of the foot.

* * * * *